United States Patent [19]

Olson et al.

[11] 4,199,105

[45] Apr. 22, 1980

[54] LOW VOLUME SPRAY DEVICE FOR SURFACE IRRIGATION SYSTEM

[75] Inventors: Donald Olson, Chula Vista, Calif.; Richard P. Georges, Winter Haven, Fla.

[73] Assignee: Olson Irrigation Systems, Santee, Calif.

[21] Appl. No.: 924,289

[22] Filed: Jul. 13, 1978

[51] Int. Cl.[2] ..... B05B 1/26

[52] U.S. Cl. ..... 239/498; 239/547

[58] Field of Search ..... 239/271, 498, 518, 524, 239/542, 547

[56] References Cited

U.S. PATENT DOCUMENTS

| | | | |
|---|---|---|---|
| 1,674,480 | 6/1928 | Nelson | 239/498 |
| 2,434,767 | 1/1948 | Hertel | 239/498 X |
| 3,779,468 | 12/1973 | Spencer | 239/542 |
| 3,815,831 | 6/1974 | Jooste | 239/547 X |

FOREIGN PATENT DOCUMENTS

| | | | |
|---|---|---|---|
| 1263654 | 5/1961 | France | 239/547 |

*Primary Examiner*—Johnny D. Cherry
*Attorney, Agent, or Firm*—Owen, Wickersham & Erickson

[57] ABSTRACT

A low volume spray device for irrigation systems has a lower tubular end portion that is beveled to facilitate its insertion into a plastic conduit. Its upper end forms a nozzle portion with a small orifice and a deflector that controls the spray pattern. The device is preferably molded from plastic material so as to be inexpensive yet long lasting.

2 Claims, 4 Drawing Figures

LOW VOLUME SPRAY DEVICE FOR SURFACE IRRIGATION SYSTEM

BACKGROUND OF THE INVENTION

In the irrigation of certain types of plants and crops it may be preferred to provide a surface distribution of water by means of spray producing nozzles. For example, in orchards such spray devices are desirable if the spray pattern can be controlled in its direction and distribution area, if the flow can be controlled at a low volume rate and if the spray profile can be kept low to avoid water on foliage. To satisfy the need for economy in large irrigation installations, such spray producing devices must be low in cost, yet durable and easy to install without the need for highly skilled and/or time consuming labor. A particular problem arose in providing a spray device that provided a relatively small droplet size in the spray pattern while maintaining adequate flow and without requiring excessive line pressure. Previously developed spray nozzle devices failed to solve all of the aforesaid problems.

BRIEF SUMMARY OF THE INVENTION

A spray nozzle for irrigation systems according to the present invention comprises a one-piece molded plastic device that is adapted to be quickly and easily inserted into a plastic conduit on the ground surface. In general, it comprises a lower tubular portion having external threads and a beveled end surface that enables it to be installed in the sidewall of the plastic conduit through a punctured hole therein.

Integral with the aforesaid lower portion is an upper enlarged head portion having a constricted orifice, and spaced above this head portion is a deflector supported by a pair of post members. This deflector has generally a conical surface with its apex in alignment with the orifice so that a stream of water striking the apex is deflected outwardly in a fan-like pattern. Along the outer edges of the deflector are a series of circumferentially spaced apart serrations or notches which serve to break up the water droplets as they move radially outwardly from the deflector apex. Thus, as water leaves the periphery of the deflector it is broken down into a small droplet size to provide a relatively uniform, fine spray pattern, which is one of the main objects of the present invention.

Another object of the invention is to provide a spray device for surface irrigation systems that is particularly well adapted for ease and economy of manufacture.

Other objects, advantages and features of the present invention will become apparent from the following detailed description of one embodiment thereof, taken in conjunction with the accompanying drawing.

DETAILED DESCRIPTION OF EMBODIMENT

Figure 1:
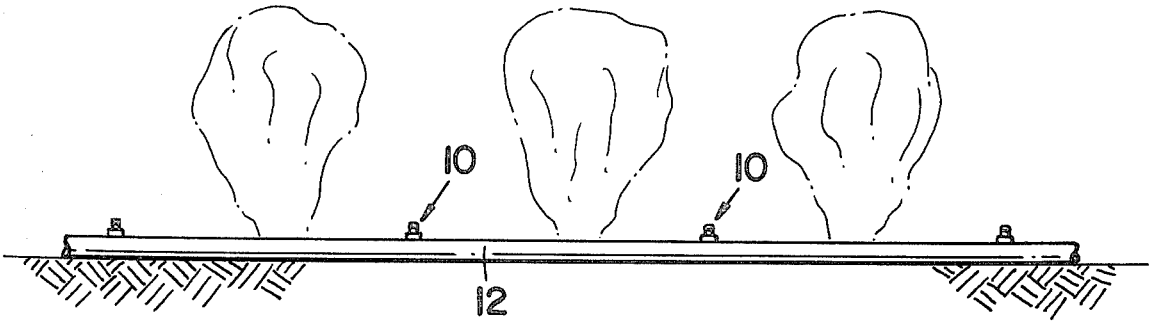
FIG. 1 is a view of a surface irrigation conduit within which are installed a series of spray devices embodying the principles of the present invention.

With reference to the drawing, FIG. 1 shows a typical arrangement for a surface irrigation system wherein a series of spray devices 10 according to the present invention, are installed at spaced apart locations in a conduit 12. The conduit, which is made of some suitable plastic material such as polyvinyl chloride (PVC), is connected to a source of water under pressure and, as indicated, may lie on the ground surface. The spray devices are installed in the conduit at whatever spacing is desired so that they can be located to provide the proper moisture pattern around the base of each plant.

Figure 3:
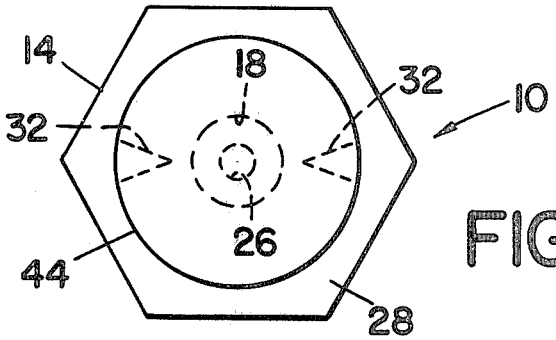
FIG. 3 is a top view of the spray device of FIG. 2.
Figure 2:
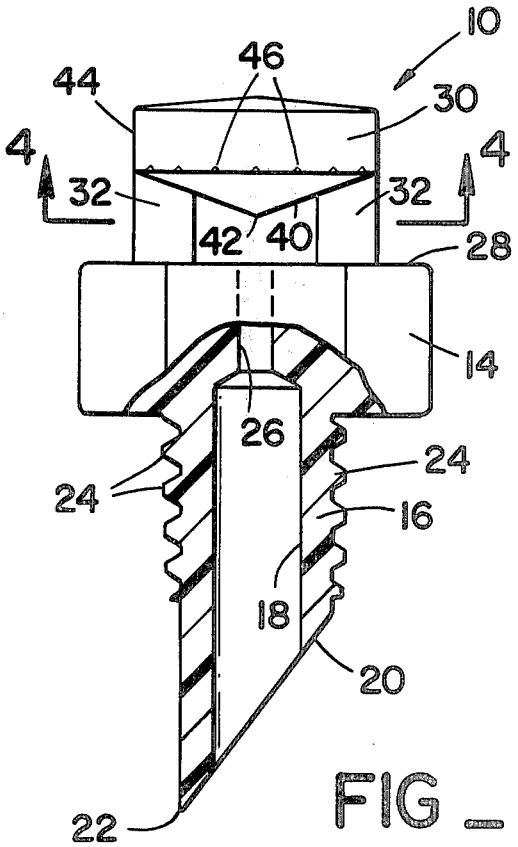
FIG. 2 is an enlarged view in elevation and in section with portions broken away showing a single spray device according to the invention.

Turning to FIGS. 2 and 3, a single spray device 10, as shown in detail, comprises a relatively large head portion 14, preferably having a flat sided exterior shape, like a hex nut. Extending downwardly from the head portion and integral therewith is a tubular stem portion 16 with a central bore 18. At its lower end this stem portion has a beveled surface 20 which forms a sharp tip 22 that enables the spray device to penetrate a plastic conduit when being installed therein. On the exterior of the stem portion just below the head portion are a series of helical threads 24 which further aid in installing the device in a conduit.

Figure 4:
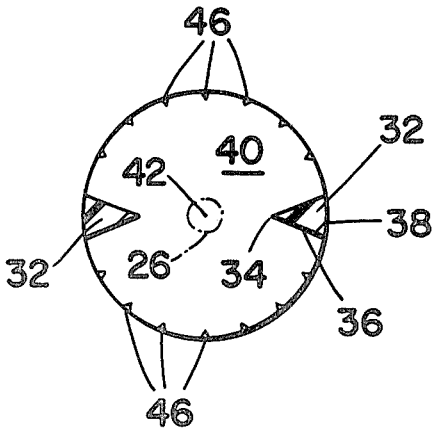
FIG. 4 is a view in section taken along the line 4—4 of FIG. 2, showing the underside of the deflector and the spray pattern produced thereby.

Within the head portion the bore 18 necks down to an axially aligned orifice 26 having a smaller diameter (e.g. 0.039 inches). This orifice exits at an opening at the center of the plane upper surface 28 of the hex-shaped head portion, and it is vertically aligned with the center of a deflector 30 spaced above the head portion. This deflector is supported by two posts 32 that are integral with and extend upwardly from the top surface 28 of the head portion. These posts are spaced apart dimetrically on the deflector and, as shown in FIG. 4, they have a triangular cross section, each having a innermost knife edge 34 with side walls 36 which diverge outwardly and are interconnected by a curved outer wall 38 that is flush with the curved outer wall of the deflector.

The deflector itself has generally a circular disc shape with a conical underside 40 that forms the deflecting surface with its apex 42 located along the extended centerline of the orifice 26. Around the outer edge of the deflector 30, where its conical deflecting surface 40 meets its outer cylindrical surface 44, are provided a series of circumferentially spaced apart serrations or notches 46. These serrations perform an important function in the operation of my spray device 10 in that they serve to break up heavier water droplets and thereby help to produce a uniform spray pattern of relatively fine droplets. Thus, during such operation, water is forced upwardly through the orifice 26 as a small stream or jet which impinges directly against the deflector surface apex 42. As the water rolls over the conical surface 40 and flows radially away from the apex it strikes the series of peripheral serrations 46 at its outer edge, thereby breaking the surface tension of the water and forming smaller droplets that are propelled outwardly in a uniform spray pattern. Even though the pressure or rate of flow of the water jet through the orifice 26 may vary somewhat, the spray pattern and its droplet size remains relatively constant and uniform. The device will function to provide an acceptable spray pattern even when water pressure is relatively low.

To install the spray device, the plastic conduit 12 may be first punched or perforated with an appropriate instrument. Thereafter, the spray device is placed in the opening formed and is pressed and twisted into a secure position with its head portion upright. The location of the spray device and other such devices can then be adjusted to provide the desired spray pattern depending on the plants being irrigated.

The configuration of my spray device is such that it can be readily produced at high volume in multicavity molds using a suitable plastic such as pvc or nylon and conventional, well-known injection molding techniques. Thus, the unit cost for the device can be kept low.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. An integral, one-piece spray device for use in a surface irrigation system and adapted to be connected to a conduit supplying liquid under pressure, said device comprising:

a head portion having an irregular exterior surface means so that it can be readily gripped for turning when inserted into said conduit;

a lower tubular portion extending downwardly from said head portion, having an axial bore and a beveled lower end;

a deflector means integrally attached to and spaced above said head portion and having a cylindrical outer surface and a smooth conical bottom surface that slopes upwardly and outwardly from a central apex to an outer edge that intersects said outer cylindrical surface;

an orifice in said head portion having a smaller diameter than and being aligned with said bore and also aligned with and spaced from said central apex of said deflector surface; and a series of small indentations spaced apart along the periphery of said deflector outer edge for decreasing the droplet size of water as it leaves said deflector means.

2. The spray device as described in claim 1 including a pair of integral post members for supporting said deflector means above said head portion, said post members extending upwardly from opposite sides of the upper surface of said head portion, each said post member having a triangular cross section with side surfaces that diverge outwardly toward said outer edge of said deflector means.

* * * * *